United States Patent [19]

Chida et al.

[11] Patent Number: 4,469,457

[45] **Date of Patent: * Sep. 4, 1984**

[54] CASSETTE TYPE INK RIBBON DEVICE

[75] Inventors: Yoshinori Chida; Satoru Tada, both of Tokyo, Japan

[73] Assignee: Seikosha Co., Ltd., Tokyo, Japan

[ * ] Notice: The portion of the term of this patent subsequent to Oct. 5, 1999 has been disclaimed.

[21] Appl. No.: 413,567

[22] Filed: Aug. 31, 1982

Related U.S. Application Data

[63] Continuation of Ser. No. 190,066, Sep. 23, 1980, Pat. No. 4,352,577.

[30] Foreign Application Priority Data

Nov. 5, 1979 [JP] Japan ..... 54-143010
Nov. 5, 1979 [JP] Japan ..... 54-143012
Apr. 4, 1980 [JP] Japan ..... 55-45487

[51] Int. Cl.[3] ..... B41J 32/02

[52] U.S. Cl. ..... 400/208; 400/202.4; 400/196.1; 242/55.19 A

[58] Field of Search ..... 400/196–198, 400/202.2, 202.4, 208, 208.1; 242/55.19 A

[56] References Cited

U.S. PATENT DOCUMENTS 2,165,739 7/1939 Verkinderen ..... 400/208.1
3,621,968 11/1971 Kondur, Jr. ..... 400/196
3,861,611 1/1975 Esashi et al. ..... 242/55.19 A
3,924,727 12/1975 Morelli ..... 400/208.1
3,945,582 3/1976 Yagi et al. ..... 400/196
4,046,247 9/1977 LaSpesa et al. ..... 400/196
4,071,133 1/1978 Scherrer et al. ..... 400/202.4
4,156,572 5/1979 Carena ..... 400/196

FOREIGN PATENT DOCUMENTS 19649 12/1980 European Pat. Off. ..... 400/208.1
2358180 5/1975 Fed. Rep. of Germany ..... 400/208
2557803 6/1977 Fed. Rep. of Germany ..... 400/197
809501 2/1959 United Kingdom ..... 400/202.4

*Primary Examiner*—William Pieprz
*Attorney, Agent, or Firm*—Robert E. Burns; Emmanuel J. Lobato; Bruce L. Adams

[57] ABSTRACT

A cassette type ink ribbon device comprises a pair of cassette cases mountable in spaced-apart non-touching relation on a printing apparatus. An endless ink ribbon extends through the pair of cassette cases. A transfer roller and an ink roller are both rotatably mounted within one of the cassette cases and are in contact with one another to replenish ink onto the ink ribbon. A slidable tensioner is disposed within the other cassette case for applying a tensioning force to the ink ribbon. The tensioner comprises a slidable guide body having a guiding surface portion in sliding contact with the inner side of the ink ribbon, a slideway within the other cassette case for slidably supporting the guide body, and a biasing spring disposed within the other cassette case for biasing the guide body along the slideway to apply a tensioning force to the ink ribbon. By such a construction, minor variations in the spacing distance between the pair of cassette cases when mounting the cassette cases on the printing apparatus can be accommodated by sliding movement of the guide body.

7 Claims, 6 Drawing Figures

CASSETTE TYPE INK RIBBON DEVICE

This is a continuation of application Ser. No. 190,066, filed Sept. 23, 1980, now U.S. Pat. No. 4,352,577.

BACKGROUND OF THE INVENTION

The present invention relates to a cassette type ink ribbon device which is employed for a printing apparatus such as an impact type serial printer, a typewriter or the like.

Cassette type ink ribbon devices heretofore in use or for sale may be divided broadly into two types. One type has a construction substantially the same as that of a cassette recording tape for a cassette tape recorder. Namely, two reels are rotatably disposed within a single cassette case and an ink ribbon is adapted to be wound up from one of the reels to the other. The other type, which is provided with an endless ink ribbon, generally has a construction as described below. Namely, the endless ink ribbon is folded over like a bellows and packed in an internal space of a single box-shaped case. The folded or packed ribbon is adapted to be pulled out from the case when it is attached to a printing apparatus. Then, the ink ribbon is adapted to be guided by guide rollers which are disposed within the case. The ink ribbon device of this type, however, has some disadvantages. Namely, the ink of the ribbon easily soils the user's hands when the device is attached to the printing apparatus. In addition, the size as well as the space for establishment is large since the case is required to have a sufficiently large internal space to pack the ink ribbon therein. Further, this internal space will become a useless and obstructive thing after the case has been attached to the printing apparatus.

SUMMARY OF THE INVENTION

It is an object of the invention to provide a novel and compact cassette type ink ribbon device for a printing apparatus.

Another object of the invention is to provide a cassette type ink ribbon device having two cassette cases which are mounted a distance apart on a printing apparatus during use of the device and which can be easily installed on the printing apparatus thereby enabling the cassette cases to be of compact size.

Still another object of the invention is to provide a cassette type ink ribbon device comprised of two separate cassette cases which house an endless ink ribbon such that no slackened part of the ribbon remains stored in the cases during use of the device thereby enabling the cases to be of compact size and to be mounted on a printing apparatus without the need for high positioning accuracy.

A still further object of the invention is to provide a cassette type ink ribbon device which can be easily assembled and can be produced at a low manufacturing cost.

BRIEF DESCRIPTION OF THE DRAWINGS

Other features and advantages of the invention will be appear from the following description of two embodiments of the invention, the novel features pointed out in the appended claims and the attached drawings in which:

DETAILED DESCRIPTION OF THE PREFERRED EMBODIMENTS

A first embodiment of the cassette type ink ribbon device incorporating the invention will be explained hereinunder.

Figure 1:
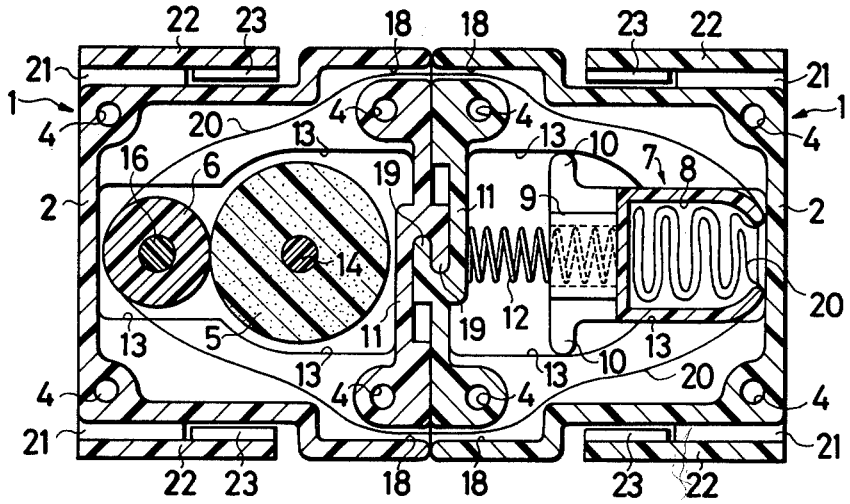
FIG. 1 is a sectional view taken along line I—I of FIG. 2 of a first embodiment of the cassette type ink ribbon device constructed in accordance with the invention showing the internal construction thereof.
Figure 2:
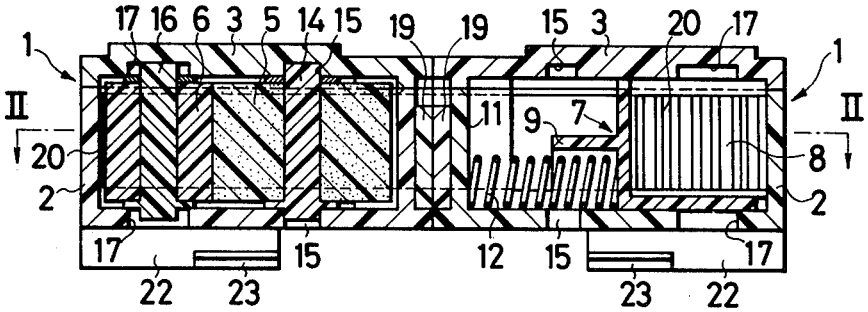
FIG. 2 is a vertical sectional view of the first embodiment.

As shown in FIGS. 1 and 2, a pair of cassette cases 1, 1 have the same configuration or shape and each of them is constituted by a lower case section 2 and an upper case section 3 made of a plastic material such as ABS or the like. The lower case section 2 is provided at corner portions thereof with four holes 4 and the upper case section 3 has projection members (not shown) at positions corresponding to the holes 4. The lower and upper case sections 2, 3 are connected together to define the case 1 by forcing the projection members into the holes 4.

Figure 3:
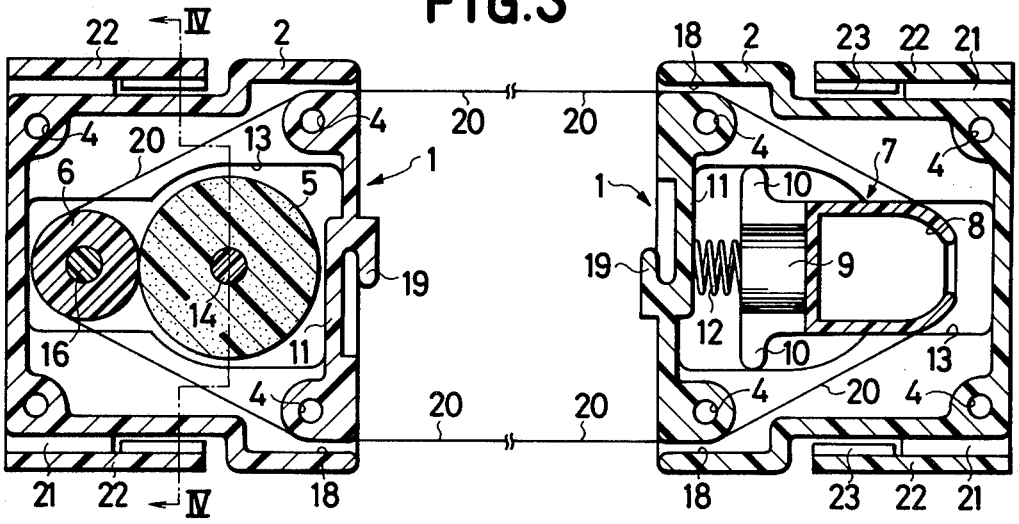
FIG. 3 is a sectional view wherein the right and left cassette cases are separated away from the coupling state as shown in FIG. 1.
Figure 4:
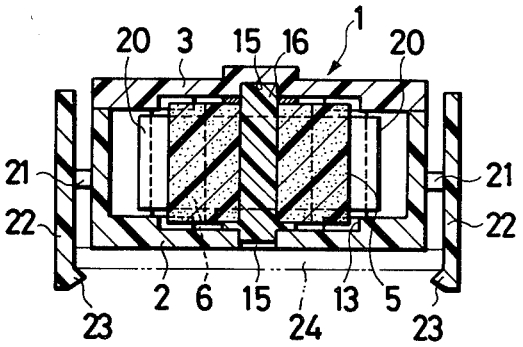
FIG. 4 is a vertical sectional view taken along line IV—IV of FIG. 3.

Within an internal space of the left case 1, an inked roller 5 and a transfer roller 6 are rotatably disposed and both of them are in contact with each other. The inked roller 5 is made of an acrylonitrile butadien rubber (NBR) and contains black ink therein. The inked roller 5 may be made of a felt, a porous rubber such as a sponge or the like, if desired. Within an internal space of the right case 1, a guide body 7 is slidably disposed. The guide body 7 has a housing or cavity 8 an inlet opened at a right end thereof, a half cylindrical portion 9 formed behind the cavity 8 and, tongue-shaped portions 10, 10 formed integrally from opposite side walls of the half cylindrical portion 9, and a curved guiding surface portion which makes sliding contact with the inner side or inside surface of an ink ribbon 20 as described hereinafter. In addition, the guide body 7 is biased rightward in the direction away from the left case by means of a coil biasing spring 12 which is arranged between the half cylindrical portion 9 and a side wall 11 of the lower case 2. The guide body 7 and the biasing spring 12 comprise a tensioner for applying a tensioning force to an ink ribbon 20 as described hereinafter. Further, the lower case 2 is provided on its bottom with a guide groove 13 which defines a slideway for slidably supporting the guide body 7 leftward and rightward. The guide groove 13 broadens at a portion by which the tongue-shaped portion 10, 10 are supported and a bearing hole 15 for rotatably supporting a shaft 14 of the inked roller 5 is bored at the center of broad part of the guide groove 13. In addition, a bearing hole 17 for rotatably supporting a shaft 16 of the transfer roller 6 is bored at the center of narrow part of the guide groove 13 and it has an elongated shape so as to slidably support the shaft 16 transversely also. The inner surface of the left lower case 2 has the same shape as that of the right lower case 2. As described above, the inner surfaces of lower and upper cases 2, 3 are manufactured and designed so as to be able to support either the guide body 7 or the rollers 5, 6. As a consequence, the left and right cassette cases 1, 1 can be employed in common although they are required to support the different internal parts respectively. Furthermore, each of the walls 11, 11 facing to oppose each other is provided at its both ends with a pair of apertures 18, 18 and on its middle portion with a coupling pawl 19. Both of the cassette cases 1, 1 are releasably coupled to each other by engaging the pawls 19, 19 as shown in FIGS. 1 and 2 and this cassette type ink ribbon device of the invention will be sold to users in such a coupled state, but the cases 1, 1 will be separated from each other by the user as shown in FIGS. 3 and 4 in order to attach them to a printing apparatus. An endless ink ribbon 20 is wound round between the transfer roller 6 of the left case 1 and the guide body 7 of the right case 1 passing through the apertures 18 and, in addition, its slackened part is folded over like a bellows and packed in the cavity 8 of the guide body 7 while the cases 1, 1 have been coupled to each other as shown in FIGS. 1 and 2. In the coupled state as shown in FIGS. 1 and 2, since the guide body 7 is biased rightward by means of the spring 12, the ink ribbon 20 is clamped between the guiding surface portion of the guide body 7 and the inner side surface of the lower case 2 by virtue of the force of the spring 12 and thus the ribbon 20 is restrained not to get away freely from the cavity 8. Consequently, the ink ribbon 20 is never entangled in the internal spaces of the cases 1, 1.

In addition, as shown in FIG. 4, each of the cassette cases, 1, 1 is provided with fulcrums 21, 21 and resilient plate member 22, 22 and the former is formed integrally from opposite side walls of the lower case 2 and the latter is formed integrally from the former in parallel to the side walls. Each of the plate members 22 is provided at the lower end thereof with a snapping pawl 23 which is positioned under the bottom of lower case 2.

The cassette type ink ribbon device of the invention is attached to the printing apparatus such as a serial printer or the like in the following manner. Namely, first, the left and right cassette cases 1, 1 will be shifted by the hands of the user so that the coupling pawls 19, 19 will be disengaged and thus the cases 1, 1 will be able to separate away from each other. As the cases 1, 1 are separated from one another as shown in FIG. 3, the slackened part of the ink ribbon 20, which had been folded over like a bellows as shown in FIG. 1, slips out from the cavity 8 against the frictional force between the right end of the guide body 7 and the inner surface of the lower case 2. Then the guide body 7 is moved leftward against the tensioning force exerted by the spring 12 along the guide groove 13 as shown in FIG. 3. As a result, the ink ribbon 20 is adapted to go round between the transfer roller 6 and the guide body 7. Thereafter, the cases 1, 1 are pushed downward against the plate 24 of the printing apparatus as shown in FIG. 4 and thus the pawls 23, 23 are engaged with the plate 24, so that the cases 1, 1 are attached on the plate 24.

In the state of attachment to the printing apparatus, the ink ribbon 20 is pulled out from the apertures 18 of the cases 1, 1 in the manner of two strips and applied a suitable tension force via the guide body 7 which is biased by means of the spring 12. At the same time, the transfer roller 6 is brought into contact with the inked roller 5 by virtue of the above-mentioned tension force. One of the two strips of the ink ribbon 20 will be disposed to pass through between a printing head and a platen (not shown). As shown in FIG. 3, no slackened part of the ink ribbon 20 remains stored within the cases when the cases are separated and mounted on the printing apparatus. Thus there is no need for a high positioning accuracy of the cases on the printing apparatus and minor variations in the spacing distance between the two cases are compensated for by the spring-biased tensioner which accordingly varies its position along the guide groove 13. When the printing head is operated, the ink ribbon 20 is driven by a feed mechanism therefor in relation to the scanning, particularly, to the carriage return and thus the transfer roller 6 and the inked roller 5 are rotated together. Since ink which has been contained in the inked roller 5 is transferred on the peripheral surface of the transfer roller 6 like a thin film, it is newly replenished to the ink ribbon 20 through the transfer roller 6. In other words, the ink of the ribbon 20 is consumed for printing of characters and replenished at the same time through the transfer roller 6 from the inked roller 5. In consequence, the ribbon 20 continues to contain ink therein as long as one likes although the latter is consumed for printing on the one hand.

In FIG. 4, the upper portions of the resilient plate members 22, are urged towards one another and made narrower by the user's hands, so that the lower portions thereof will be further separated and broadened and the pawls 23, 23 will be released from the plate 24. Thus the cases 1, 1 will be able to be removed upward from the plate 24 by lifting thereon up.

Figure 5:
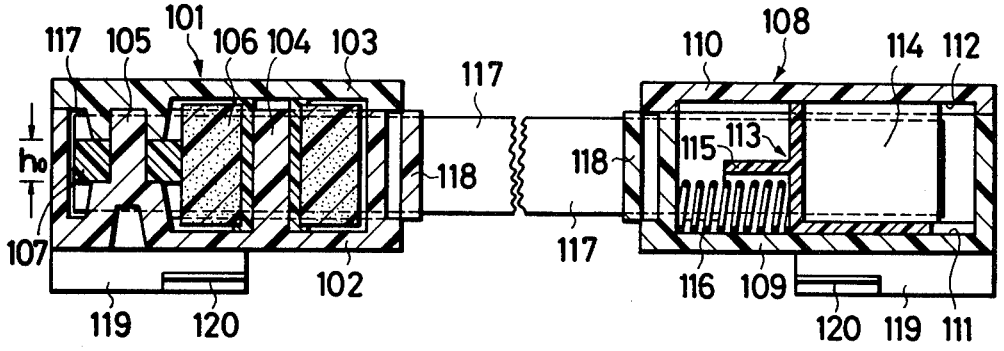
FIG. 5 is a vertical sectional view of a second embodiment of the cassette type ink ribbon device constructed in accordance with the invention wherein the right and left cases are separated away in the same manner as shown in FIG. 3.
Figure 6:
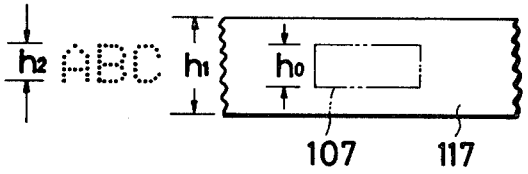
FIG. 6 is a fragmentary view of the ink ribbon illustrating a few characters printed out by a printing head and a transfer roller of the second embodiment.

A second embodiment of the invention will be described hereinunder referring to FIG. 5.

A left cassette case 101 is constituted by a lower case 102 and an upper case 103. The lower case 102 is provided with projections 104 and 105 integrally formed therefrom in order to rotatably support an inked roller 106 and a transfer roller 107 respectively. A right cassette case 108 is constituted by a lower case 109 and an upper case 110, which are provided on respective inner surfaces thereof with guide grooves 111 and 112 for slidably supporting a guide body 113. Namely, in this second embodiment, the left cassette case 101 has only a funtion to rotatably support the inked roller 106 and the transfer roller 107 and the right cassette case 108 has only a function to slidably support the guide body 113. The guide body 113 is provided with a housing or cavity 114 and a half cylindrical portion 115 and biased rightward by means of a coil biasing spring 116, the guide body 113 and the biasing spring 116 forming a tensioner as in the first embodiment. Endless ink ribbon 117 is passed through apertures (not seen in FIG. 5) of the cassette cases 101 and 108 and gone round between the transfer roller 107 and the guide body 113. In addition, the cassette cases 101 and 108 have coupling pawls 118 and resilient plate members 119 provided at its lower end with snapping pawls 120.

By the way, although the ink ribbon 117 has a width of $h_1$, only a central area thereof is utilized for the practical printing of characters whose heigh is $h_2$. Therefore, the transfer roller 107 is manufactured and designed so as to provide a height of $h_0$ which is substantially equal to or a little smaller than $h_2$. Thus, the ink ribbon 117 is replenished ink only at the central area thereof which is practically utilized for printing. In order to suitably adjust or control a replenishment quantity of ink for the ribbon 117, the transfer roller 107 may have an outer surface other than flat one.

According to the cassette type ink ribbon device incorporating the present invention, the device can be produced to a compact or small size at a low cost and the space for attachment thereof can be decreased. In addition, as the slackened part of ink ribbon is adapted to be packed into the cavity of the guide body, which is slidably supported in one of the cassette cases, during assembly and which acts as a tensioner for the ink ribbon by virtue of the spring when the device is attached to the printing apparatus and the same is restrained not to get away easily from the cavity by the biased guide body during assembly, the slackened ink ribbon is never entangled. Further, as the ink ribbon is given a tension through the guide body biased by means of the spring, no tension application means is required to be specially arranged on the printing apparatus, and thus the space for attachment of the device and component parts can be decreased furthermore. Moreover, its life can be elongated sufficiently and, in the case that the transfer roller is designed to have a width corresponding to a height of characters printed out by a printing head, a replenishment quantity of ink is suitably controlled and thus very satisfactory long life of the ribbon can be realized. In addition, handling, attachment and removal of the device are easy and smooth.

What we claim is:

1. In a cassette type ink ribbon device of the type comprising a pair of cassette cases mountable in spaced-apart non-touching relation on a printing apparatus during use of the device: an endless ink ribbon extending through the pair of cassette cases and having inner and outer opposite sides; a transfer roller and an ink roller both rotatably mounted within one of said pair of cassette cases and being in contact with one another to replenish ink onto said ink ribbon; and a slidable tensioner for applying a tensioning force to said ink ribbon and disposed within the other of said pair of cassette cases, the tensioner comprising a slidable guide body having a guiding surface portion in sliding contact with the inner side of the ink ribbon, means defining a slideway within the said other cassette case for slidably supporting the guide body, and biasing means disposed within said other cassette case for biasing the guide body along the slideway to apply a tensioning force to the ink ribbon whereby minor variations in the spacing distance between the pair of cassette cases when mounting thereof on a printing apparatus can be accomodated by sliding movement of the guide body.

2. A cassette type ink ribbon device according to claim 1; wherein the biasing means comprises a biasing spring compressed between the guide body and an inner part of said other cassette case.

3. A cassette type ink ribbon device according to claim 2; wherein the biasing spring overlies the slideway and extends lengthwise along the slideway.

4. A cassette type ink ribbon device according to claim 3; wherein the biasing means applies to the ink ribbon a tensioning force which can be overcome during mounting of the pair of cassette cases on the printing apparatus so as to enable sliding movement of the guide body along the slideway to thereby compensate for minor variations in the spaced-apart distance at which the pair of cassette cases are mounted on the printing apparatus.

5. A cassette type ink ribbon device according to claim 1; wherein the biasing means applies to the ink ribbon a tensioning force which can be overcome during mounting of the pair of cassette cases on the printing apparatus so as to enable sliding movement of the guide body along the slideway to thereby compensate for minor variations in the spaced-apart distance at which the pair of cassette cases are mounted on the printing apparatus.

6. A cassette type ink ribbon device according to claim 1; wherein the means defining a slideway comprises a guide groove in an inner part of said other cassette case.

7. A cassette type ink ribbon device according to claim 1; wherein the guiding surface portion of the guide body has a curved shape which curves in a direction from the middle of the guiding surface portion back towards the guide body.

* * * * *